United States Patent [19]

Pfeifer

[11] 4,254,527

[45] Mar. 10, 1981

[54] WINDOW CLEANING IMPLEMENT

[76] Inventor: Peter H. Pfeifer, Saentisstrasse 144, 1000 Berlin 48, Fed. Rep. of Germany

[21] Appl. No.: 4,640

[22] Filed: Feb. 21, 1979

[30] Foreign Application Priority Data

Feb. 6, 1978 [DE] Fed. Rep. of Germany ..... 2805316

[51] Int. Cl.[3] ..... A47L 13/14; A47L 23/04

[52] U.S. Cl. ..... 15/121

[58] Field of Search ..... 15/121, 117, 118, 250.11, 15/209; 401/6-8, 24

[56] References Cited

U.S. PATENT DOCUMENTS

| | | | |
|---|---|---|---|
| 2,285,412 | 6/1942 | Caldwell | 15/126 |
| 3,537,123 | 11/1970 | Leland | 15/244 |
| 3,783,469 | 1/1974 | Siemund | 15/209 R |
| 4,037,975 | 7/1977 | Huffman | 401/6 |
| 4,079,478 | 3/1978 | Andrews, Sr. | 15/22 A |

FOREIGN PATENT DOCUMENTS

| | | | |
|---|---|---|---|
| 521795 | 2/1956 | Canada | 15/121 |
| 1461322 | 3/1969 | Fed. Rep. of Germany | 401/6 |
| 2643717 | 8/1977 | Fed. Rep. of Germany | 15/121 |
| 1387384 | 12/1964 | France | 15/121 |

*Primary Examiner*—Leonard D. Christian

[57] ABSTRACT

An improved window cleaning implement of the type including a support plate having a handle secured thereto and having a groove therein adjacent one end of the plate and extending transverse to the direction of movement of the plate during a cleaning operation, a wiper blade mounted on the plate within the groove for contacting the window during a cleaning operation, and a wiping cloth supported by the plate for contacting the window during a cleaning operation and having one end attached to one side of the wiper blade, wherein the improvement comprises an elastic strip extending from the other side of the wiper blade and having its free end secured to said one end of the support plate for floatably mounting the wiper blade within the groove, the groove being dimensioned so as to permit movement of the wiper blade therein during a cleaning operation. Another embodiment comprises an improved window cleaning implement of the type including a support plate having a front surface for supporting both a wiping cloth and a wiper blade for contacting the window during a cleaning operation, and including a handle secured to the rear surface of the support plate, wherein the improvement comprises a handle having one end secured to the rear surface of the support plate and extending substantially parallel to the direction of movement of the plate during a cleaning operation, the free end of the handle being situated adjacent the rear surface of the support plate and having a bulge for permitting grasping of the handle by only the fingers.

4 Claims, 4 Drawing Figures

Fig. 1
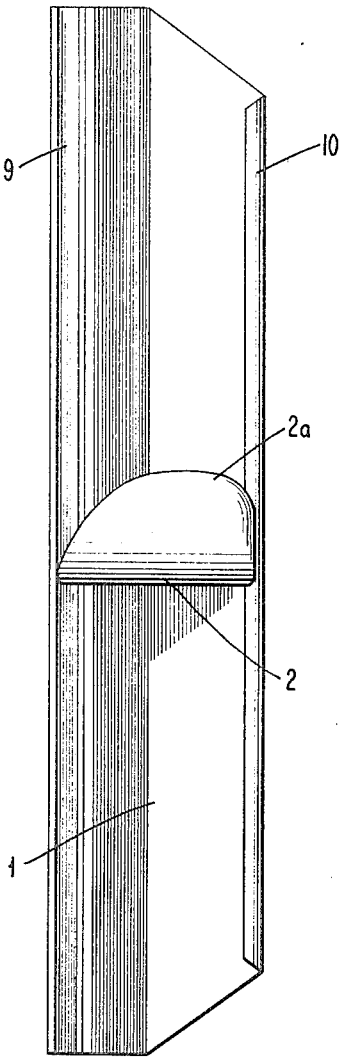
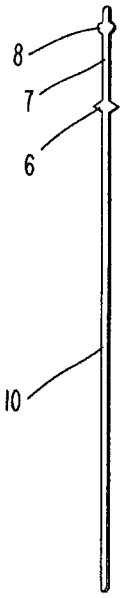
Fig. 3
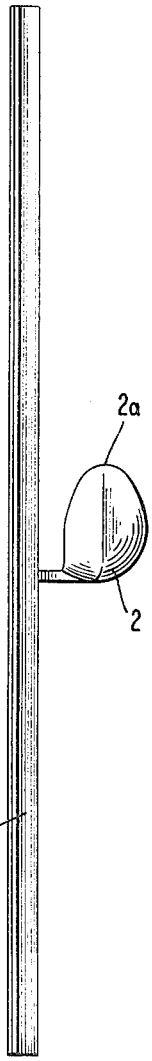
Fig. 2
Fig. 4
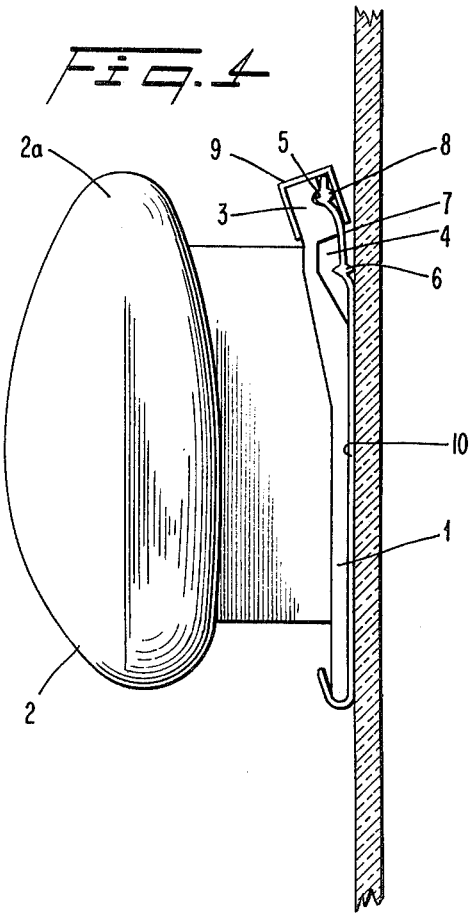

WINDOW CLEANING IMPLEMENT

The invention incorporates a hand-operated instrument for wet-cleaning window-panes; it consists of a plate elongated across the washing direction and with a wiping cloth strung across it; it consists also of a handle as described in German Pat. No. 26 43 717.

In this patent a wiper blade has been worked into the wiping cloth; it is fixed into a groove which is located in the rear edge of the plate with respect to the wiping direction. When the instrument is drawn across a glass surface, then the surface which is to be cleaned is first wiped by the cleaning cloth and then by the wiper, so that the window pane is cleaned in a single working operation.

In this design, the groove construction and the wiper-blade width must be precisely dimensioned so that the wiper-blade extends minimally beyond the plane of the wiping cloth. It is particularly important that the groove be manufactured absolutely straight. Any slight deviation, such as a light wave form, is carried over to the wiper-blade with the result that the wiper-blade does not fully come into contact with the glass surface to be cleaned, which in turn causes improper cleaning. However, a correct, straight and exactly dimensioned groove construction is particularly expensive. A construction using aluminium or other materials such as plastic, leads to the described inaccuracies, such as a slight wave form. Elimination of such faults is expensive and leads to a considerable increase in the overall manufacturing cost of the instrument.

The present improvement is thus designed to reduce the instrument susceptibility to faults arising during manufacture, and to attain a very even, (adjusted to the plane of the wiping cloth) contact of the wiper-blade with the glass surface to be cleaned.

The solution to this problem, in accordance with the invention, is that an elastic strip is fixed to the wiper on the side opposite to the full surface of the wiping cloth (the side of the wiper which is nearest the edge); the outer side of this elastic strip is fixed at the rear edge of the elongated plate and the groove into which the wiper blade is placed is made larger than the wiper blade. Since the wiper blade thus does not rest in the groove, the elastic strip allows it to bend back when the instrument is pressed against the surface to be cleaned. Inaccurate manufacture of the groove thus no longer has any effect. Even inaccuracies in the instrument itself, where the edge of the elastic strip is fastened, can be balanced out to a certain degree by the elasticity. The instrument is thus considerably less susceptible to manufacturing faults.

A second factor for increasing the cleaning effect of the instrument, is to ensure that the surface of the wiping cloth lies evenly and as completely as possible against the surface to be cleaned. This is particularly important in the case of very dirty window panes.

This goal is attained by the fact that the wiper blade, with the aid of the elastic strip, bends back so far during contact with the surface to be cleaned that the wiper blade no longer extends beyond the working plane of the wiping cloth.

With a hand-operated instrument for wet-cleaning window-panes in a single working operation, it is important that both units for washing and also for drying, always lie evenly on the glass surface. If such an instrument has a long handle, such as for example the instrument which is described in U.S. Pat. No. 2,625,700, then, if the instrument is used rapidly (such as in professional use) one of the units will always lift off the glass surface. This results in an unclean finish. It is thus important that no strong lever action arises when the instrument is used rapidly, as this would cause the instrument to partly lift off from the glass surface.

This goal is attained by applying a short handle directly to the rear of the plate. The handle is fixed vertically to the long side of the plate and has a heavy bulge on the right-hand side, to enable a good finger grip.

The special effect of this short handle with bulge, is that it only requires holding with fingers and not with the entire palm of the hand. This results in the fact that, during work with the instrument, depending on the position of the arm, the handle can be moved in the hand in such a way that it always has the angle necessary, since the handle does not lie fully and thus rigidly in the hand. Laterally occurring forces do not lead to a tilting of the instrument, since a short handle only has a small lever action. This is in contrast to a long handle which, with its heavy lever action, easily leads to a tilting of the instrument.

In this shorter version of the handle, a more costly construction is eliminated, such as a pivot between the handle and the plate.

Due to the vertical arrangement of the handle, it is possible to carry out, in rapid professional use, left and right turns, and the one-sided bulge prevents the instrument from slipping out of the hand.

The aforementioned two improvements thus allow the instrument to always lie completely flat on the glass surface to be cleaned.

These improvements are further explained in an application example below on.

FIG. 1 is a plan view of the instrument from the rear, looking onto the handle.

FIG. 2 is a side view of the instrument looking at the long side.

FIG. 3 represents the wiping cloth and the wiper blade alone, in a side view.

FIG. 4 is a side view from the narrow edge of the instrument, where by the cleaning cloth is attached to the instrument and the instrument lies against the glass surface to be cleaned. FIGS. 1 and 2 are shown in a smaller scale while FIGS. 3 and 4 are shown in a larger scale.

On an elongated plate (1) a handle (2) in a short version has been mounted. The handle has a bulge (2*a*) so that it can be gripped with four fingers. On the long front side of the elongated plate (1) there is a head rail (3) mounted at an obtuse angle. Between this head rail and the elongated plate, there is a large lengthwise running groove (4).

This groove provides sufficient space for the wiper blade (6) without causing the latter to rest against the base of the groove while the instrument is in use. An elastic strip (7) is applied to the wiper blade; this is attached to the head rail (3) with the help of a U-profile clamping device (9). To prevent the elastic strip from slipping, a double-sided bulge (8) has been applied to it; the double sided bulge is pressed into a small lengthwise running groove (5) by the clamping device (9). On the other side of the wiper blade (6), the wiping cloth (10), which covers the elongated plate (1), has been attached.

In the practical design the wiper blade, the elastic strip and the double-sided bulge is made in one piece, out of rubber or material similar to rubber (FIG. 3).

Since the wiper blade is fastened elastically, it thus bends back (when in contact with the glass surface to be cleaned) so far that it is flush with the plane of the wiping cloth. Inaccuracies arising in the production of the instrument are thus evened out and the wiper blade rests securely on the glass surface.

Since the handle is fastened in a short form directly to the rear of the plate, and since thus ony minimal lever action arises, during operation, the instrument lies securely against the surface to be cleaned, and is not tilted. The vertical arrangement and the lateral bulge permit a rapid professional application of the instrument.

I claim:

1. An improved window cleaning implement of the type including a support plate having a handle secured thereto and having a groove therein adjacent one end of the plate and extending transverse to the direction of movement of the plate during a cleaning operation, a wiper blade mounted on the plate within the groove for contacting the window during a cleaning operation, and a wiping cloth supported by the plate for contacting the window during a cleaning operation and having one end attached to one side of the wiper blade, wherein the improvement comprises:

an elastic strip extending from the other side of the wiper blade and having its free end secured to said one end of the support plate for floatably mounting the wiper blade within the groove, said groove being dimensioned so as to permit movement of the wiper blade therein during a cleaning operation.

2. An improved window cleaning implement as claimed in claim 1, further comprising a locking groove situated adjacent said one end of the plate, and a generally U-shaped clamp for securing the free end of the elastic strip to the support plate, and wherein the free end of the elastic strip includes a double-sided bulge which is press fitted in said locking groove by said clamp.

3. An improved window cleaning implement of the type including a support plate having a front surface for supporting both a wiping cloth and a wiper blade for contacting the window during a cleaning operation, and including a handle secured to the rear surface of the support plate, wherein the improvement comprises:

a handle having one end secured to the rear surface of the support plate and extending substantially parallel to the direction of movement of the plate during a cleaning operation, the free end of the handle being situated adjacent the rear surface of the support plate and having a bulge for permitting grasping of the handle by only the fingers.

4. An improved window cleaning implement as claimed in claim 3, wherein the bulge extends to one side of the secured end of the handle.

* * * * *